United States Patent [19]

McCain

[11] 3,948,417

[45] Apr. 6, 1976

[54] HAIR ROLLER DISPENSER

[76] Inventor: Lou M. McCain, 1124 "F" Ave., Coronado, Calif. 92118

[22] Filed: Sept. 30, 1974

[21] Appl. No.: 510,243

[52] U.S. Cl. ..... 221/135; 221/279; 132/9; 206/205; 312/45

[51] Int. Cl.[2] ..... A45D 6/00

[58] Field of Search ..... 221/56, 57, 58, 93, 123, 221/135, 150 A, 150 B, 226–232, 279, 280, 312 C; 312/45; 206/205, 207; 132/9, 40; 222/386.5

[56] References Cited

UNITED STATES PATENTS

| | | | |
|---|---|---|---|
| 2,185,605 | 1/1940 | Murphy et al. | 221/279 X |
| 2,598,156 | 5/1952 | Brill et al. | 221/280 |
| 2,617,519 | 11/1952 | O'Sullivan | 206/205 |
| 3,304,141 | 2/1967 | Rogers | 312/45 |
| 3,625,397 | 12/1971 | Shelly et al. | 221/279 X |

*Primary Examiner*—Robert B. Reeves
*Assistant Examiner*—Joseph J. Rolla
*Attorney, Agent, or Firm*—Brown & Martin

[57] ABSTRACT

A hair roller dispenser comprising an open-topped container divided into a plurality of vertical compartments of several different sizes for containing vertically stacked hair rollers. The container is filled with a germicidal liquid to sterilize the rollers after each use, and each compartment is provided with a spring or float to bias the rollers upwardly in a position above the upper edges of the container so that the rollers are easily accessible from the top as needed. The rollers may be made buoyant to obviate the need for a biasing member.

3 Claims, 6 Drawing Figures

HAIR ROLLER DISPENSER

BACKGROUND OF THE INVENTION

It is common practice in hair dressing salons to use a number of cylindrical hair rollers when setting hair or performing other related processes on the hair. Typically the operator will have a tray in which the rollers are kept prior to and after use, and not uncommonly shelves, table tops or other available surfaces are availed of to temporarily store the rollers between uses.

Several different sizes of rollers are used, and during the course of a busy day the rollers may become scattered about in several different places, with the various sizes mixed together, leading to general disorganization in the hair dressing operation and resulting in unsightly clutter.

In addition, it is the law in some, if not all states that rollers must be disinfected between applications to prevent the spread of disease among patrons. But in practice this regulation is frequently if not generally ignored, especially when a number of patrons must be treated in quick succession and the prospect of sorting the used rollers from the fresh ones and disinfecting the former looms as an unnecessary and time consuming bother.

SUMMARY OF THE INVENTION

The present invention was conceived to ameliorate the above mentioned undesireable conditions and comprises a single unit which stores a large number of hair rollers segregated according to size in a container of disinfectant solution. The container is internally divided by apertured baffles into a series of vertical compartments of selective sizes, each compartment being just large enough in horizontal cross-section to receive a particular size of roller without binding and of sufficient vertical dimension to accomodate a sizeable stack of rollers. Each compartment is provided with a means of upwardly biasing the roller stack. The biasing means is either a spring compressed against the container bottom or a small float, in either case the upward force being that required to raise the top roller in the stack partially out of the disinfectant solution to permit easy access thereto.

The exterior of the container is provided with several compartments or bins in which the operator can store various accessories such as hair clips, setting lotion, and spray, and the entire unit is preferably adjustably mounted on a mobile pedestal for the convenience of the operator.

The primary object of this invention, therefore, is to provide a new and improved hair roller dispenser.

Another object of this invention is to provide a hair roller dispenser in which the rollers are consistently fed to an accessible position for easy removal.

A further object of this invention is to provide a hair roller dispenser in which the rollers are immersed in a sterilizing solution while stored.

Other objects and advantages will be apparent in the following detailed description, taken in conjunction with the accompanying drawing, in which.

Figure 1:
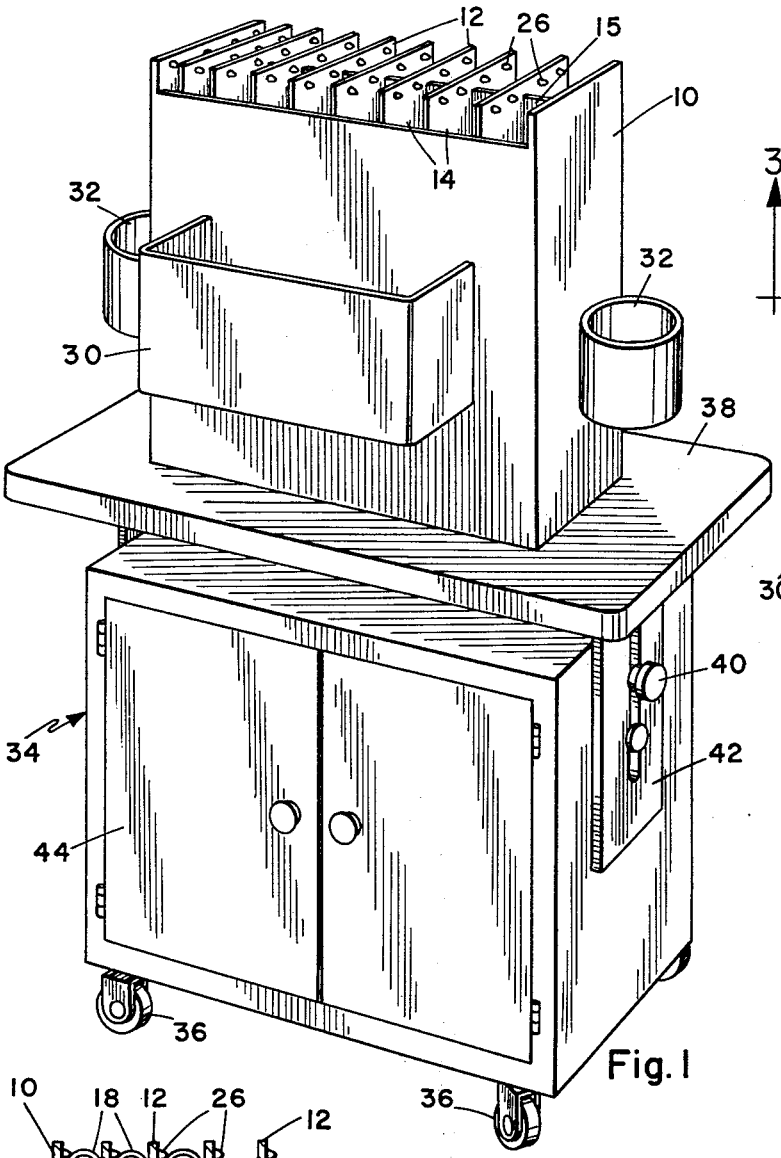
FIG. 1 is a perspective view of the dispenser on a supporting cabinet.

The dispenser comprises a rectangular open-topped container 10 made of plastic or any other suitable impermeable substance. Disposed within the container is a compartment with a plurality of baffles 12 which divide the compartment into vertically extended compartments 14. The baffles may be initially mounted in the compartment or container, or provided separately with means for interlocking to form the entire baffle structure which is then inserted into the compartment and rests in the container without being attached, the latter arrangement clearly being advantageous from a maintainance and cleaning standpoint. In the example illustrated there are two rows of compartments on opposite sides of a center divider 15. Since the container will normally be filled with germicidal fluid, the baffles and center divider are provided with enough holes 16 to permit fluid flow and communication among all of the compartments so that the liquid level will equalize. In a modified embodiment, fluid flow is also accomplished by having the upper ends of some of the baffles slightly lower than the container sides that permits fluid overlfow from one compartment to the next.

Figure 2:
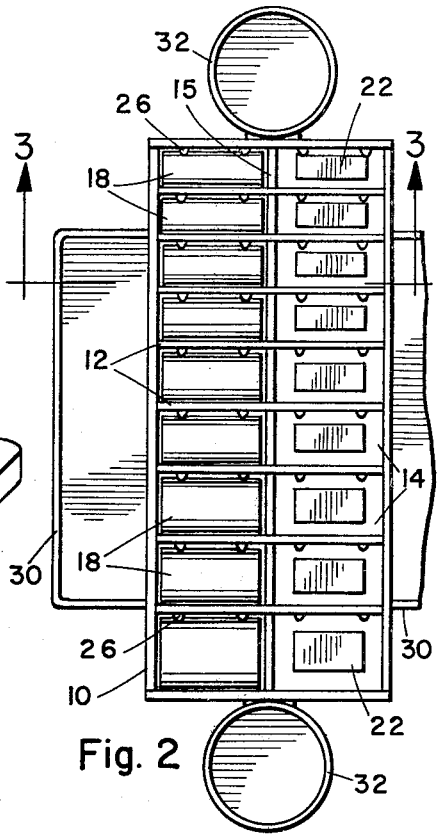
FIG. 2 is a top plan view of the dispenser unit.

Each of the compartments 14 is sized to loosely receive a vertical stack of hair rollers 18, and to accomodate the different roller sizes used to impart various degrees of curl to the hair. So at least come of the compartments have different dimensions in horizontal cross section as is best illustrated in FIG. 2, to receive the different size hair rollers.

Figure 3:
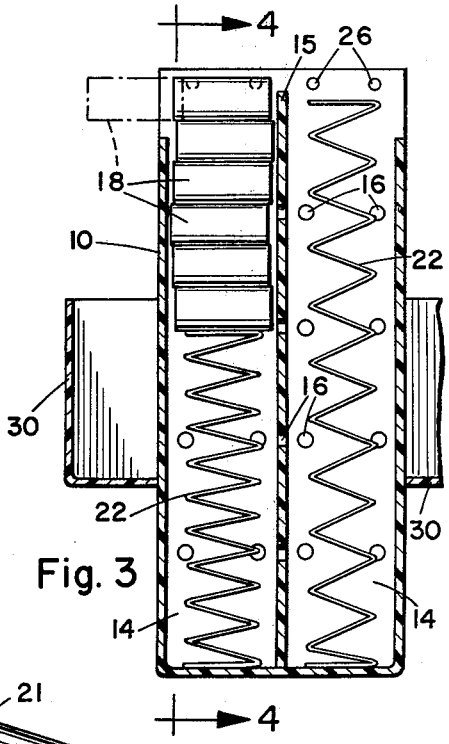
FIG. 3 is sectional view taken on line 3—3 of FIG. 2.
Figure 4:
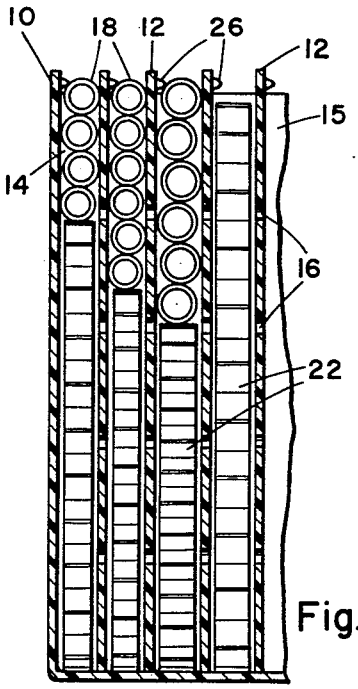
FIG. 4 is a sectional view taken on line 4—4 of FIG. 3.
Figure 5:
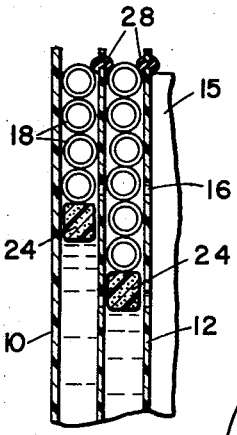
FIG. 5 is a sectional view, similar to a portion of FIG. 4, showing an alternative float arrangement for lifting the rollers.
Figure 6:
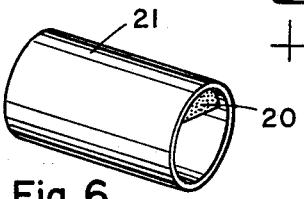
FIG. 6 is a perspective view of a typical roller with integral float means.

Because the rollers currently on the market are negative buoyant, means are provided to bias the roller stacks upwardly so that the top rollers are easily accessible. One means of accomplishing this is by making the rollers buoyant. This is accomplished by either constructing the rollers with floatable material, or; as illustrated in FIG. 6, by securing a piece of buoyant material 20 in a hair roller 21 of conventional design. However, clearly the most economical structure is to include a bias means in the compartments, as illustrated in FIGS. 3, 4 and 5, which produce the desired result when non-buoyant rollers are used.

The bias means can be a spring of any suitable form inserted or mounted in the bottom of each compartment, such as a coil spring, or as illustrated, an accordian leaf spring 22. It is desirable for such springs to extend upward to very near the top of the container so that the last rollers in any given compartment will be properly positioned. Small flotation bobs are also used in place of the springs, one of which is shown at 24 in FIG. 5. The bobs have the advantages of economy and simplicity over the springs, but do not provide an increased biasing force for an increasingly tall roller stacks, as do springs when increasingly compressed.

Each of the laterally extended baffles is provided with detents, bumpers or burr type projections 26 that prevent upward movement of the rollers beyond a given point. Thus the springs or other bias means can be designed with sufficient strength to be effective for all load variations without ejecting the upper rollers from the fluid under full load conditions. The bumpers may also be produced a double ended rubber modlings 28 which are snapped through apertures in the upper edges of the lateral baffles, as in FIG. 5. The rollers are most conveniently removed from the side, as in the broken line position in FIG. 3, but if the rollers and/or the retaining bumpers are sufficiently resilient, the rollers may be snapped out upwardly.

For the further convenience of the operator, the container walls have externally mounted accessory bins 30 and 32 that are constructed to meet the particular needs of the hair dressing trade. Rectangular lateral bins 30 are used as hair clip containers, and the cylindrical holders 32 provided on each end of the unit are for hair spray cans and setting lotion bottles.

The entire unit as thus far described rests on a mobile pedestal or cabinet 34 having wheels or casters 36 so that the dispenser can be conveniently positioned during the various phases of the hair styling process. The pedestal has an upper table 38 which may be tray-like or simply flat as shown, and the dispenser is either mounted to the table or temporarily supported thereon. The table is vertically adjustable by any convenient means such as by the knobs 40 which releasibly engage the slotted supports 42 which are mounted to the underside of the table. Storage space is preferably provided in the pedestal in the form of shelves, a cabinet 44, or the like. It will be noted that the particular design of the pedestal is not of significance to the invention, the important features being mobility and the provision of some means of vertically adjusting the dispenser to accomodate operators of different heights. The dispenser can be used independently of a pedestal or cabinet structure and be supported on any convenient horizontal surface.

Having described my invention, I now claim:

1. A hair roller dispenser comprising:

an impermeable open-topped container for receiving and containing germicidal liquid, a plurality of vertical baffles disposed in said container and defining a plurality of vertically extended compartments with each compartment being dimensioned to receive a vertical stack of hair rollers, each of said compartments having disposed therein means for upwardly biasing a stack of hair rollers placed therein when said container contains the germicidal liquid, each of said bias means comprising a buyant body, whereby a stack of rollers placed on top of one of said buoyant bodies will be biased upwardly by the buoyant force of the body in said germicidal liquid, the upper ends of said baffles extending above the upper edges of said container, and the upper baffle ends having bumper means positioned above the upper container edges for preventing further upward movement of the top roller, whereby said roller can be removed by being moved laterally from under said bumper means and above the upper container edges.

2. A hair roller dispenser comprising:

an impermeable open-topped container for receiving and containing germicidal liquid, a plurality of vertical baffles disposed in said container and defining a plurality of vertically extended compartments with each compartment being dimensioned to receive a vertical stack of hair rollers, each of said compartments having disposed therein means for upwardly biasing a stack of hair rollers placed therein when said container contains the germicidal liquid, a plurality of hair rollers arranged in vertical stacks disposed in said compartments, said rollers being buoyant in germicidal liquid and comprising said biasing means, the upper ends of said baffles extending above the upper edges of said container, and the upper baffle ends having bumper means positioned above the upper container edges for preventing further upward movement of the top roller, whereby said roller can be removed by being moved laterally from under said bumper means and above the upper container edges.

3. Structure according to claim 2 wherein, said rollers are substantially cylindrical and hollow and each has buoyant material attached to the interior thereof.

* * * * *